US006987935B2

(12) United States Patent
Lee

(10) Patent No.: US 6,987,935 B2
(45) Date of Patent: Jan. 17, 2006

(54) DEVELOPER SUPPLY AND RECOVERY SYSTEM USED WITH WET ELECTRO-PHOTOGRAPHIC IMAGE FORMING APPARATUS, AND METHOD THEREOF

(75) Inventor: Jung-han Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/988,504

(22) Filed: Nov. 16, 2004

(65) Prior Publication Data

US 2005/0129422 A1 Jun. 16, 2005

(30) Foreign Application Priority Data

Dec. 12, 2003 (KR) ..... 10-2003-0090558

(51) Int. Cl.
*G03G 15/10* (2006.01)

(52) U.S. Cl. ..... 399/57

(58) Field of Classification Search ..... 399/57, 399/81, 237

See application file for complete search history.

(56) References Cited

U.S. PATENT DOCUMENTS

| | | | | |
|---|---|---|---|---|
| 6,687,477 | B2 * | 2/2004 | Ichida et al. | 399/237 |
| 2005/0053398 | A1 * | 3/2005 | Kim et al. | 399/237 |

FOREIGN PATENT DOCUMENTS

| | | |
|---|---|---|
| JP | 55-036855 | 3/1980 |
| JP | 56-114948 | 9/1981 |
| JP | 03-068471 | 3/1991 |
| JP | 11-072932 | 3/1999 |

* cited by examiner

*Primary Examiner*—Quana Grainger
(74) *Attorney, Agent, or Firm*—Stanzione & Kim, LLP

(57) ABSTRACT

A developer supply and recovery system used with a wet electro-photographic image forming apparatus includes a supply pump installed on a supply line to supply a developer from an ink cartridge to a development bath, a recovery pump installed on a recovery line to recover the developer from a developer container to the ink cartridge, an overflow sensor installed at the developer container to sense the developer overflowing from the development bath, a control unit to control the supply pump and the recovery pump in response to a sensed value of the overflow sensor, wherein operation states of the supply pump and the recovery pump are sensed, and the developer is appropriately contained in the developer container such that air is not introduced together with the developer recovered to the recovery pump, thereby reducing noise.

24 Claims, 7 Drawing Sheets

DEVELOPER SUPPLY AND RECOVERY SYSTEM USED WITH WET ELECTRO-PHOTOGRAPHIC IMAGE FORMING APPARATUS, AND METHOD THEREOF

CROSS-REFERENCE TO RELATED APPLICATIONS

This application claims the priority of Korean Patent Application No. 2003-90558, filed on Dec. 12, 2003, in the Korean Intellectual Property Office, the disclosure of which is incorporated herein in its entirety by reference.

BACKGROUND OF THE INVENTION

1. Field of the Invention

The present general inventive concept relates to a developer supply and recovery system used with a wet electro-photographic image forming apparatus, and more particularly, to a developer supply and recovery system used with a wet electro-photographic image forming apparatus, and a developer supply and recovery method using the same, in which whether a developer supply unit and a developer recovery unit are normally operated before printing is sensed, and a noise generated from the recovery unit is reduced during printing.

2. Description of the Related Art

In a wet electro-photographic image forming apparatus, a charge unit charges a surface of a photosensitive medium, and the charged surface of the photosensitive medium is exposed to light radiated from an exposure unit depending on a print signal to form an electrostatic latent image. An image is formed from the electrostatic latent image using a developer supplied from a development unit, and then a transfer belt transfers the formed image onto a print medium, thereby obtaining a desired image.

The wet electro-photographic image forming apparatus employs a contact charge way in which the charge unit is in contact with the photosensitive medium to form an electrical potential on the surface of the photosensitive medium. A difference in electrical potentials applied to the respective units is used to attach the developer to the electrostatic latent image formed on the photosensitive medium or to transfer the image from the photosensitive medium to the transfer belt or from the transfer belt to the print medium.

Further, the wet electro-photographic image forming apparatus includes a development roller to attach the developer to the electrostatic latent image formed on the photosensitive medium, and a developer supply and recovery system to supply the developer to a development roller and to recover a remaining developer.

FIG. 1 is a view illustrating a conventional developer supply and recovery system of a wet electro-photographic image forming apparatus.

Referring to FIG. 1, a developer supply and recovery system includes an ink cartridge 10 for storing a developer therein, a supply line 11 for connecting the ink cartridge 10 with a development bath 14, a supply pump 12 installed on a supply line 11 to supply the developer from the ink cartridge 10 to the development bath 14, a recovery line 17 for connecting the ink cartridge 10 with a developer container 13 for temporarily containing the developer overflowing from the development bath 14, and a recovery pump 18 installed on the recovery line 17 to recover the developer contained in the developer container 13 to the ink cartridge 10.

The development bath 14 includes a development roller 16 and a photosensitive drum 15 at an upper side thereof. The development roller 16 is installed to have one portion thereof dip into the developer of the development bath 14 such that the stored developer is supplied to the photosensitive drum 15 having an electrostatic latent image formed thereon. The photosensitive drum 15 is installed to rotate in contact with the development roller 16 while developing the electrostatic latent image with the supplied developer.

An operation of the above-constructed developer supply and recovery system will be described.

If the supply pump 12 is operated, the developer stored in the ink cartridge 10 flows into the development bath 14 through the supply line 11, and the developer supplied to the development bath 14 is transferred to the photosensitive drum 15 by the development roller 16 to develop the electrostatic latent image formed on the photosensitive drum 15.

In the meantime, the developer not supplied to the photosensitive drum 15 by the development roller 16 overflows from the development bath 14, and is then contained in the developer container 13. The developer contained in the developer container 13 is recovered by the recovery pump 18 to the ink cartridge 10 through the recovery line 17 provided at a bottom side of the developer container 13 to be re-supplied to the development bath 14 through the supply line 11, thereby maintaining a print operation.

However, since the conventional developer supply and recovery system cannot exactly perceive states of the supply line 11, the supply pump 12, the recovery line 17 and the recovery pump 18, it cannot perceive whether or not the developer normally flows from the development bath 14 to the ink cartridge 10.

Accordingly, the conventional developer supply and recovery system has drawbacks in that if the supply line 11 and the supply pump 12 malfunction, the developer is not smoothly supplied to the development roller 16, thereby causing the electrostatic latent image not to be developed, and if the recovery line 17 and the recovery pump 18 malfunction, the developer overflows from the development bath 14 such that the developer contained in the developer container 13 is not recovered but overflows from the developer container 13, thereby polluting image forming apparatuses.

Further, the conventional developer supply and recovery system has drawbacks in that if the recovery pump 18 is not exactly controlled, the recovery pump 18 operates to recover the developer in a state where the developer does not exist at the developer container 13. That is, in a state where an inlet of the supply line 17 is not completely dipped into the developer contained in the developer container 13, air is introduced into the recovery line 17 together with the developer, thereby causing noise. The noise occurs because an amount of the developer contained in the developer container 13 is not appropriately controlled.

SUMMARY OF THE INVENTION

In order to solve the foregoing and/or other problems, it is an aspect of present general inventive concept to provide a developer supply and recovery system used with a wet electro-photographic image forming apparatus, and a developer supply and recovery method using the same, in which whether a developer supply pump and a developer recovery pump are normally operated before printing is sensed, thereby reducing a noise generated from the recovery unit during printing.

Additional aspects and advantages of the present general inventive concept will be set forth in part in the description which follows and, in part, will be obvious from the description, or may be learned by practice of the general inventive concept.

The foregoing and/or other aspects of the present general inventive concept, may be achieved by providing a developer supply and recovery system used with a wet electro-photographic image forming apparatus, the system including a recovery pump installed on a recovery line to recover a developer from a developer container to an ink cartridge, an overflow sensor installed at the developer container to sense the developer overflowing from a development bath, a control unit which controls operations of a supply pump and the recovery pump in response to a value sensed by the overflow sensor, wherein operation states of the supply pump and the recovery pump are sensed, and the developer is appropriately contained in the developer container such that air is not introduced together with the developer recovered by the recovery pump, thereby reducing a noise.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
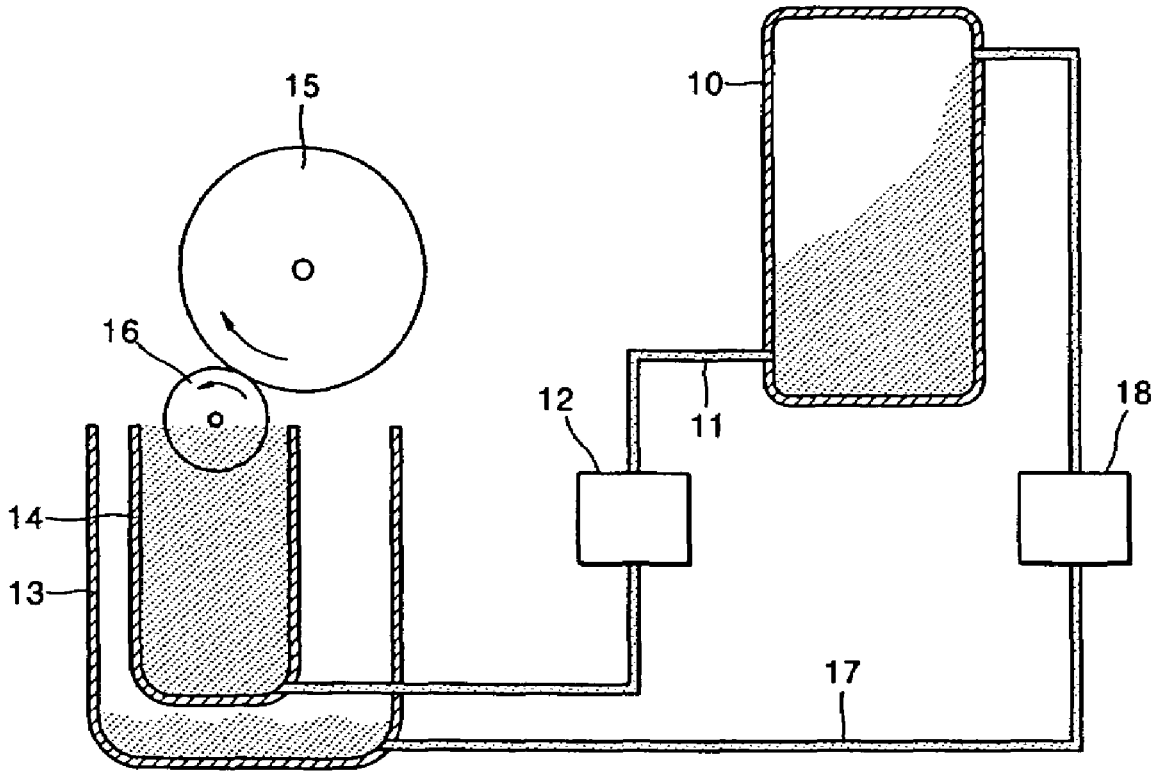
FIG. 1 (PRIOR ART)
FIG. 1 is a view illustrating a conventional developer supply and recovery system of a wet electro-photographic image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
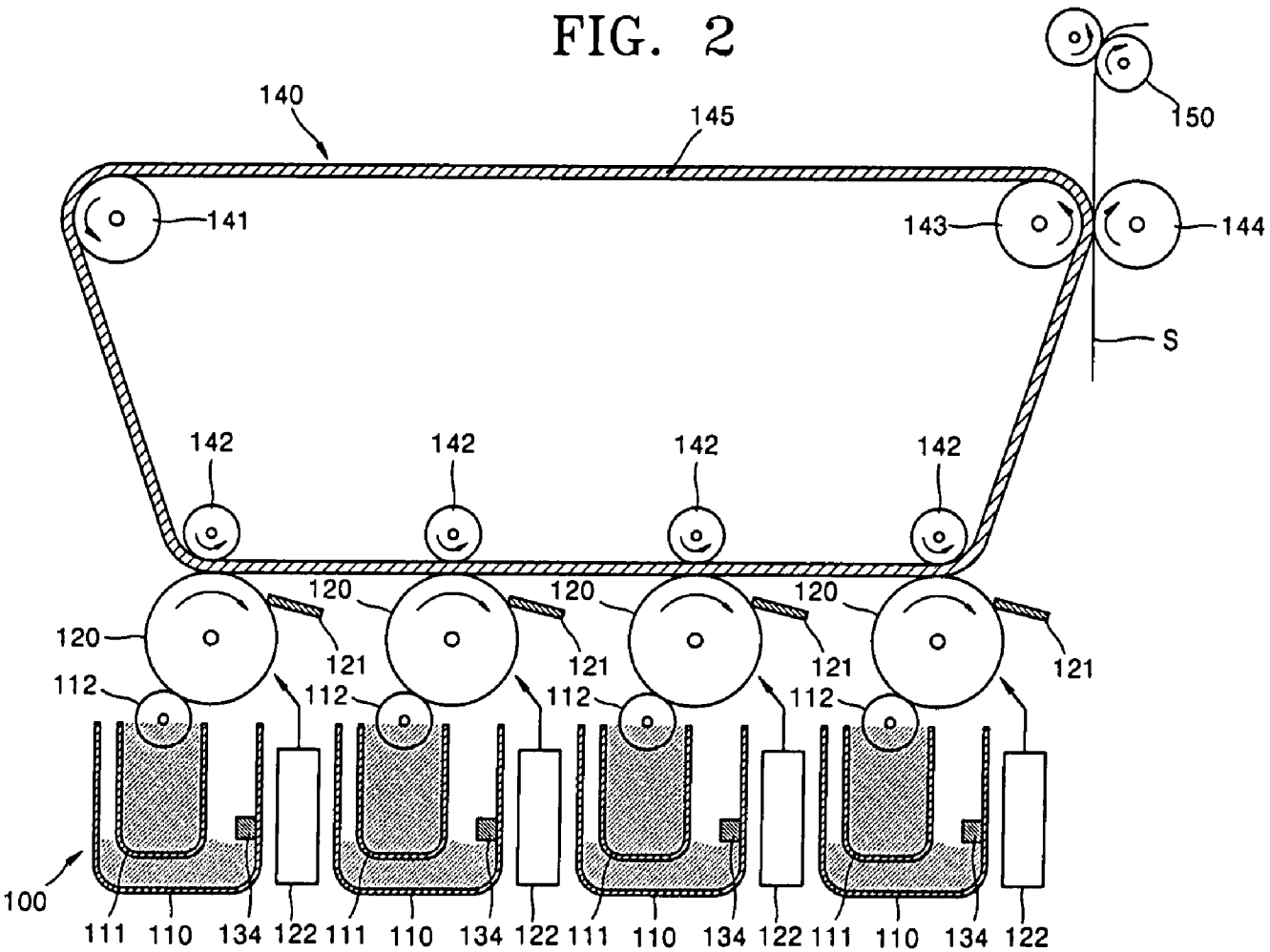
FIG. 2 is a view illustrating a wet electro-photographic image forming apparatus including a developer supply and recovery system according to an embodiment of the present general inventive concept.
Figure 3:
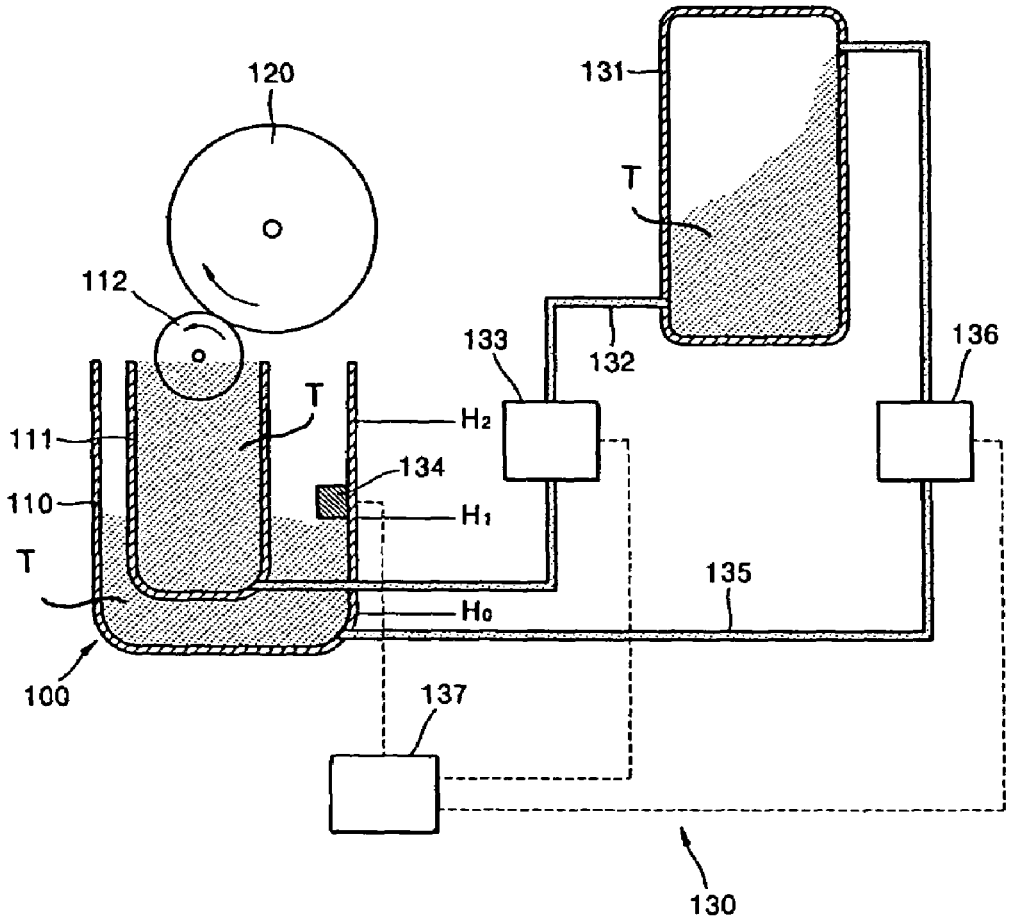
FIG. 3 is a view illustrating the developer supply and recovery system of FIG. 2.

FIG. 2 is a view illustrating a wet electro-photographic image forming apparatus including a developer supply and recovery system according to an embodiment of the present general inventive concept, and FIG. 3 is a view illustrating an a developer supply and recovery system according to another embodiment of the present general inventive concept.

Referring to FIGS. 2 and 3, the wet electro-photographic image forming apparatus may include a development unit 100, a developer supply and recovery system 130, a transfer unit 140 and a fixing unit 150.

The development unit 100 may include a plurality of development units so as to form a color image, and can supply a developer T to each of electrostatic latent images formed on photosensitive drums 120 by exposure units 122 to develop the electrostatic latent images. The development unit 100 may include a development bath 111 to contain the developer T, and a developer container 110 to temporarily contain the developer overflowing from the development bath 110.

A development roller 112 being in contact with the photosensitive drum 120 to supply the developer T to the photosensitive drum 120 can be installed in the development bath 111 such that a portion thereof is dipped into the developer T. Accordingly, the developer T contained in the development bath 111 can be supplied to the photosensitive drum 120 through the development roller 112 such that the electrostatic latent image formed on the photosensitive drum 120 is developed using the developer T, and the developer T not supplied to the photosensitive drum 120 by the development roller 112 may overflow from the development bath 111 to flow into the developer container 110.

The developer supply and recovery system 130 may include a supply pump 133 installed on a supply line 132 to supply the developer T stored in an ink cartridge 131 to the development bath 111, a recovery pump 136 installed on a recovery line 135 to recover the developer T contained in the developer container 110 to the ink cartridge 131, and an overflow sensor 134 installed at the developer T container 110 to sense the developer overflowing from the development bath 111.

Further, the developer supply and recovery system 130 may further include a control unit 137 connected to the overflow sensor 134, the supply pump 133 and the recovery pump 136 to control their operations.

Referring to FIG. 3, the developer container 110 may have indications of H0, H1, and H2 each representing height from a bottom of the developer container 110. These indications are determined by predetermined heights depending on an amount of the developer T stored by the supply pump 133 in the developer container 110 and exhausted by the recovery pump 136 from the developer container 110.

The transfer unit 140 can be supported by a driving roller 141, a development backup roller 142 and a transfer backup roller 143 such that a closed curve configuration is formed. The transfer unit 140 may include a transfer belt 145 having the image developed by the developer T transferred from the photosensitive drum 120 and rotating together with the driving roller 141, the transfer backup roller 143, and the development backup roller 142, and a transfer roller 144 to face the transfer backup roller 143 with respect to the transfer belt 145 such that the transfer belt 145 is interposed therebetween to transfer the image transferred to the transfer belt 145 to paper S.

The fixing unit 150 is installed on a paper eject path to apply heat and pressure to the image transferred to the paper S to fuse the image on the paper S.

A reference numeral 121 represents a cleaning blade installed to be in contact with the photosensitive drum 120 to clean the remaining developer that is not transferred from the photosensitive drum 120 to the transfer belt 145. A reference numeral 122 represents a charger to charge the photosensitive drum 120.

An operation of the above-constructed wet electro-photographic image forming apparatus is described with reference to FIGS. 2 and 3.

The developer stored in the ink cartridge 131 can be supplied to the development bath 111 through the supply line 132. The developer supplied to the development bath 111 can be supplied to the photosensitive drum 120 by the development roller 112 to develop the electrostatic latent image formed on the photosensitive drum 120.

The images respectively formed on the photosensitive drums 120 by the developing unit 100 having the plurality of development units through the above operation can be sequentially transferred to the transfer belt 145 to overlap one another so that a desired image is formed.

The image formed on the transfer belt 145 can be transferred to the paper S passing between the transfer roller 143 and the transfer backup roller 144, and the transferred image can be fixed on the paper S when the paper S passes through the fixing unit 150.

Meanwhile, the developer T which Is not supplied to the photosensitive drum 120 or overflows from the development bath 111, can be stored in the developer container 110 and then, can be recovered using the recovery pump 136 to the ink cartridge 131. The overflow sensor 134 can sense an amount or a height of the developer T overflowing from the development bath 111 to the developer container 110. The control unit 137 connected to the overflow sensor 134 can control operations of the supply pump 133 and the recovery pump 136 to allow an appropriate amount of the developer T to be contained in the developer container 110 or to determine whether the supply pump 133 and the recovery pump 136 are operated in an orderly fashion.

Figure 4A:
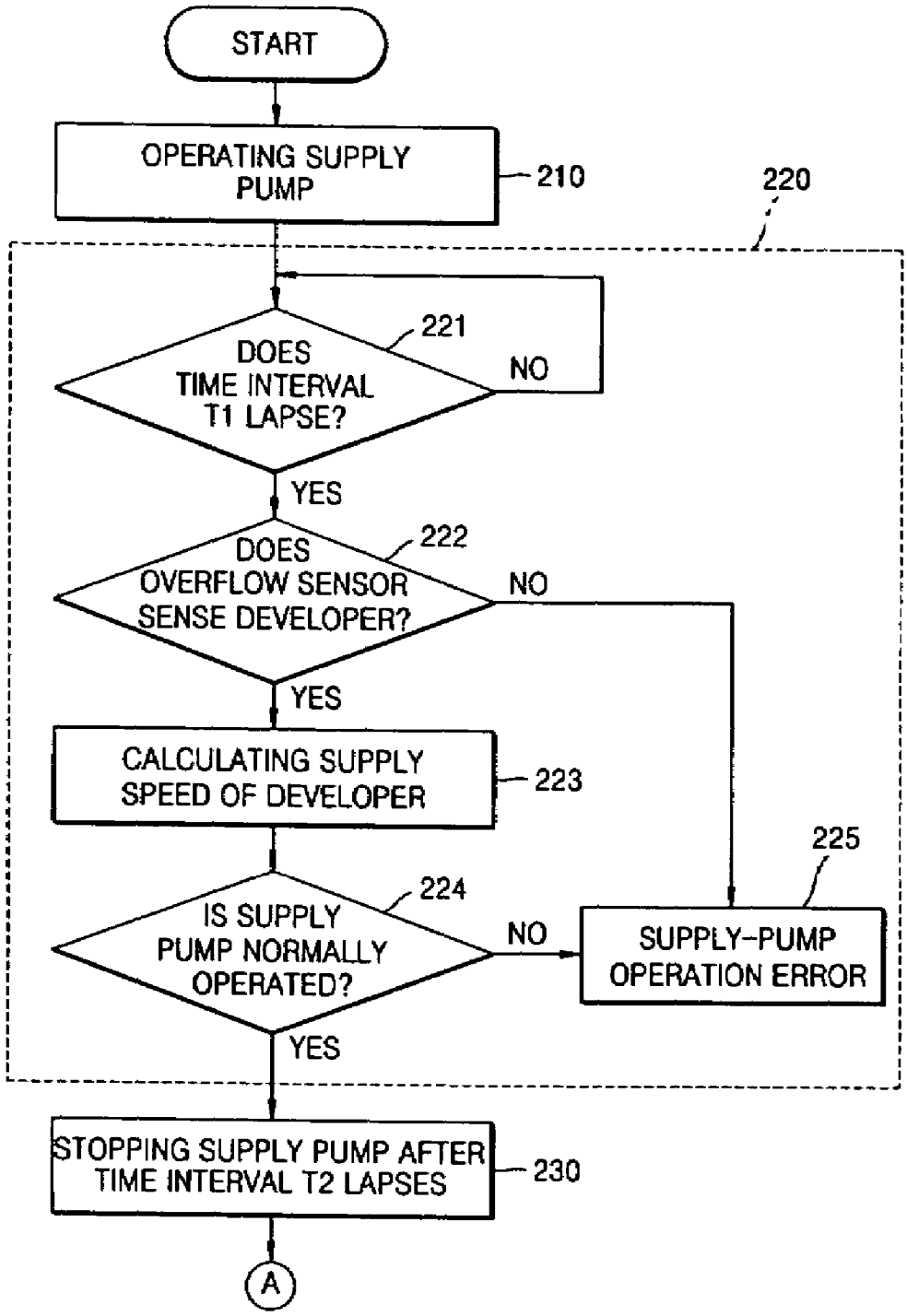
FIGS. 4A and 4B are flow charts illustrating a method of determining whether a developer is normally supplied and recovered according to another embodiment of the present general inventive concept.
Figure 4B:
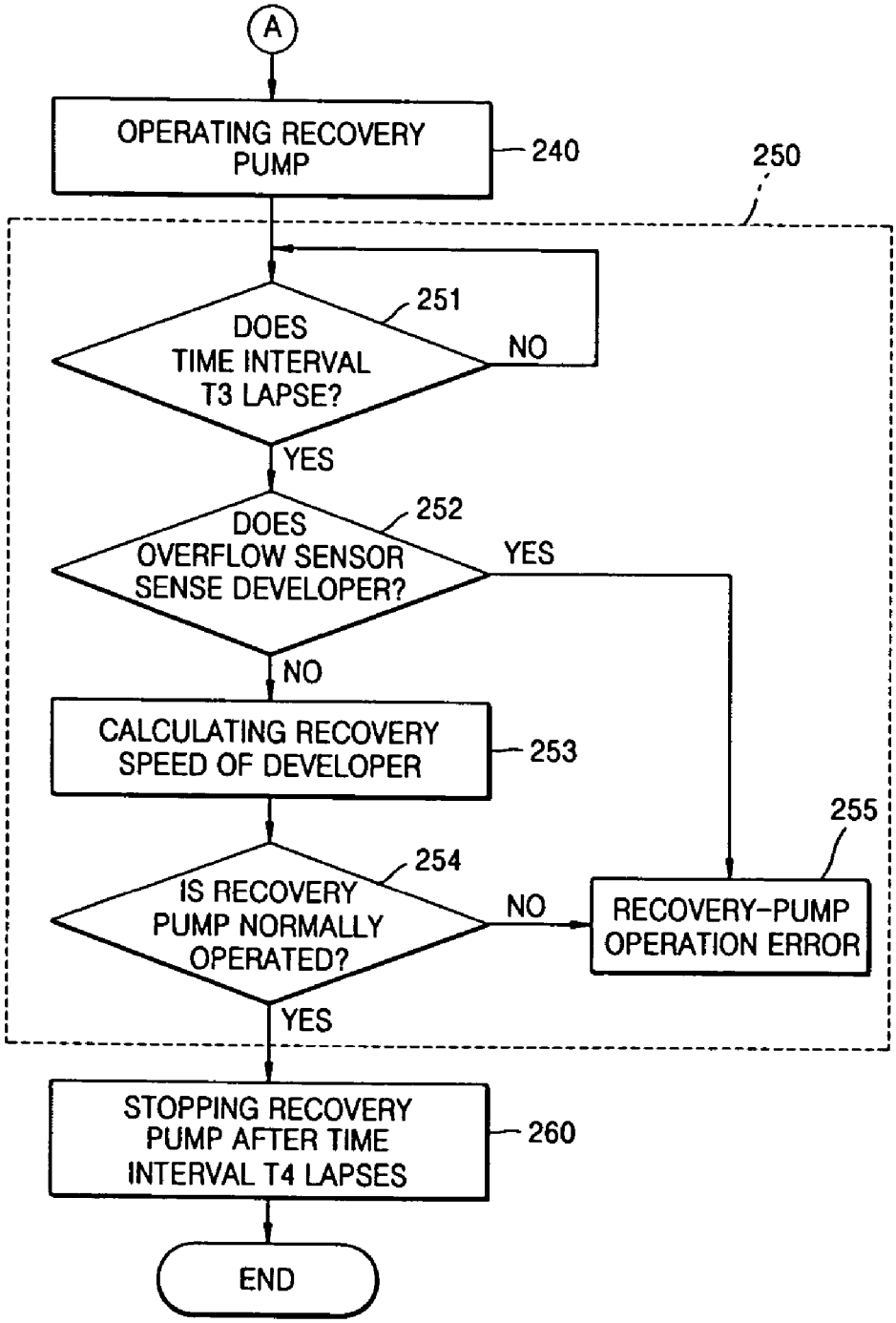
Figure 5:
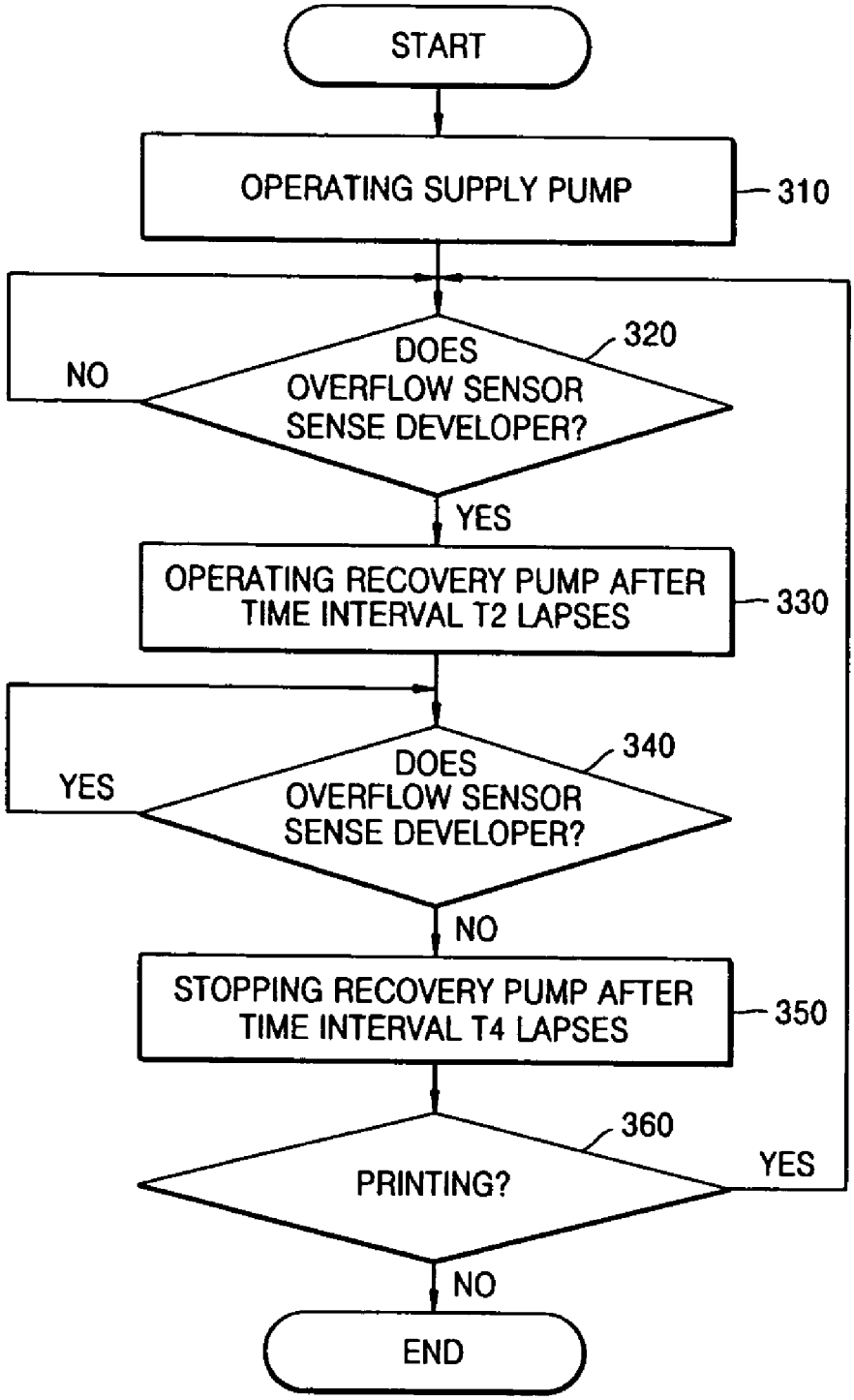
FIG. 5 is a flow chart illustrating a developer recovery method of reducing noise according to another embodiment of the present general inventive concept.
Figure 6:
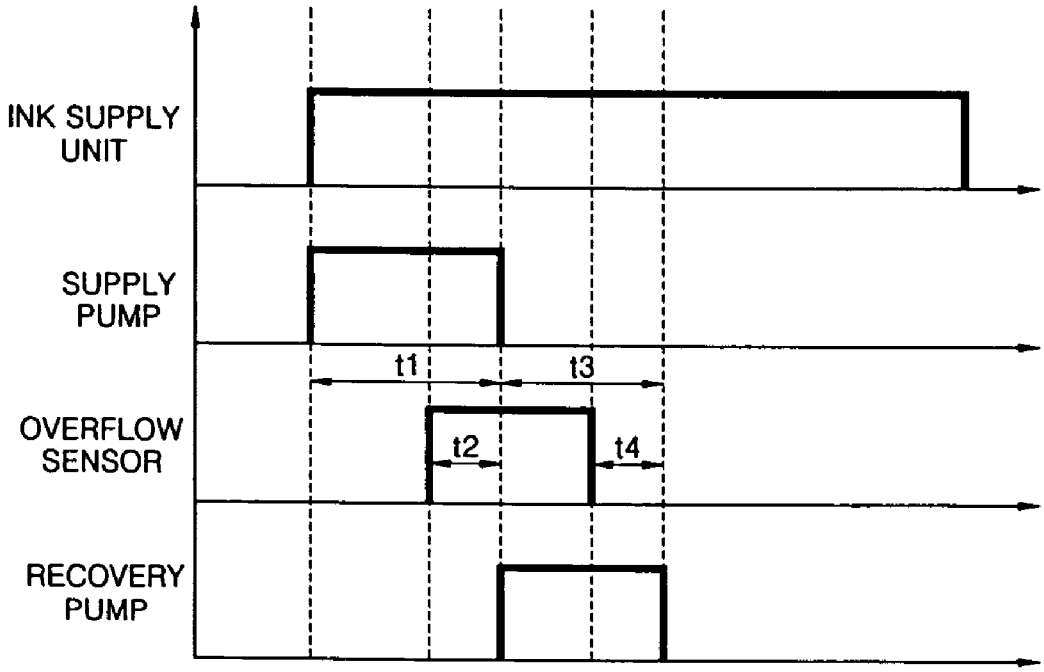
FIG. 6 is a timing diagram illustrating the method of determining whether a developer is normally supplied and recovered in the developer supply and recovery system, as shown in FIGS. 2 through 5.

FIGS. 4A and 4B are flow charts illustrating a method of determining whether a developer is normally supplied and recovered according to another embodiment of the present general inventive concept, and FIG. 6 is a timing diagram illustrating the method of determining whether the developer is normally supplied and recovered in the wet electro-photographic image forming apparatus shown in FIGS. 2 through 5.

Referring to FIGS. 2 through 6, before the wet electro-photographic image forming apparatus performs a print operation, a speed of the developer flowing through the supply pump 133 and the recovery pump 136 is measured and determined so as to determine whether the developer smoothly flows through the supply line 133 and the recovery line 135 being not clogged or whether the supply pump 133 and the recovery pump 136 are normally operated.

The supply pump 133 can be operated to supply the developer stored in the ink cartridge 131 to the development bath 111 (operation 210). The control unit 137 can control to measure a time interval t1 counted (calculated) from an operation time of the supply pump 133, and to determine whether the time interval t1 lapses. Here, the time interval t1 represents a predetermined time taken for the developer to be supplied by an operation of the supply pump 133 such that the developer overflowing from the development bath 111 is housed up to the height H2 of the developer container 110. The time interval t1 can be determined depending on the supply pump 133 and the supply line 132.

If it is determined that the time interval t1 lapses, the control unit 137 can control to determine whether the overflow sensor 134 senses the developer (operation 222). If it is determined that the time interval t1 does not lapse, it is again determined whether the time interval t1 lapses.

If the overflow sensor 134 does not sense the developer, it is determined that the developer does not flow from the development bath 111 to the developer container 110 even though the time interval t1 counted from the operation time of the supply pump 133 lapses. Since it indicates that the supply line 132 is clogged or the supply pump 133 is not smoothly operated, a message of "supply-pump operation error" can be displayed on a display of the image forming apparatus or can be notified to a user (operation 225).

When the overflow sensor 134 senses the developer, a supply speed of the developer supplied to the development bath 111 through the supply line 132 can be calculated (operation 223). Since the time interval t1 taken to supply the developer, and the amount of the developer supplied to the development bath 111 can be appreciated, the supply speed of the developer can be calculated.

The control unit 137 can measure the calculated supply speed of the developer to compare the measured supply speed with a previous stored supply speed. When it is determined that they are identical to each other, it is determined that the supply line 132 and the supply pump 133 are normally operated. When they are not identical to each other, it is determined that the supply line 132 is clogged or the supply pump 133 is not normally operated, thereby displaying the message of "supply-pump operation error" to notify the user.

In the determining operation 221 through the displaying operation 225, it is determined whether the developer is normally supplied through the supply line 132 and the supply pump 133 in operation 220.

The control unit 137 can stop the supply pump 133 after a time interval t2 lapses (operation 230). Here, the time interval t2 represents an interval from a time when the overflow sensor 134 senses the developer, until a time when the developer reaches the height H2.

The control unit 137 can control the recovery pump 136 to operate to recover the developer contained in the developer container 110 to the ink cartridge 131 (operation 240). The control unit 137 can measure a time interval t3 from an operation time of the recovery pump 136, and can determine whether the time interval t3 lapses (operation 251). Here, the time t3 represents a predetermined time taken for the developer to be reduced from the height H2 to the height H1 of the developer container 110 when the developer is recovered by an operation of the recovery pump 136 from the developer container 110 to the ink cartridge 131. The time t3 can be determined depending on the recovery pump 136 and the recovery line 135.

If it is determined that the time interval t3 lapses in operation 251, the control unit 137 can determine whether the overflow sensor 134 senses the developer (operation 252). If it is determined that the time interval t3 does not lapse, the determining operation 29 can repeat to determine whether the time interval t3 lapses.

If the overflow sensor 134 senses the developer, it indicates that the developer is not normally recovered, thereby not being reduced from the height H2 to the height H1 of the developer container 110 even though the time interval t3 lapses from the operation time of the recovery pump 136. Since it indicates that the recovery line 135 is clogged or the recovery pump 136 is not smoothly operated, a message of "recovery-pump operation error" can be displayed on the display of the image forming apparatus or can be notified to the user (operation 255).

When the overflow sensor 134 senses the developer, the supply speed of the developer recovered from the developer container 110 to the ink cartridge 131 through the recovery line 135 can be calculated (operation 253). Since the time interval t3 taken to recover the developer, and the amount of the developer supplied to the ink cartridge 131 can be appreciated, the recovery speed of the developer can be calculated.

The control unit 137 can measure the calculated recovery speed of the developer to compare the measured recovery speed with the previously stored recovery speed. When it is determined that they are identical to each other, it can be determined that the recovery line 135 and the recovery pump 136 are normally operated. When it is determined that they are not identical, it can be determined that the recovery line 135 is clogged or the recovery pump 136 is not normally operated, thereby displaying the message of "recovery-pump operation error" to notify the user.

In the determining operation 251 through the displaying operation 255, it is determined whether or not the developer is normally supplied through the recovery line 135 and the recovery pump 136 in operation 250.

The control unit 137 can stop the recovery pump 136 after a time interval t4 lapses (operation 260). Here, the time interval t4 represents an interval from a time when the overflow sensor 134 senses the recovered developer, until a time when the developer reaches the height H0.

FIG. 5 is a flow chart illustrating a developer recovery method of reducing noise according to another embodiment of the present general inventive concept.

Referring to FIGS. 3 and 5, while the print operation is performed, the noise can be prevented from being generated due to the air introduced together with the developer into the recovery line 135 in a procedure of recovering when the developer is recovered from the developer container 110 to the ink cartridge 131.

The noise may occur when the developer is recovered to the ink cartridge 131 through the recovery pump in a state where the developer is not housed up to an appropriate height of the developer container 110. The amount of the developer and the operation of the recovery pump 136 are appropriately controlled such that the noise can be prevented from being generated while the developer is recovered together with the air from the development container 110.

The supply pump 133 can be operated to supply the developer stored in the ink cartridge 131 to the development bath 111 (operation 350). The developer overflowing from the development bath 111 can be housed while gradually filling in the developer container 110. The overflow sensor 134 can determine whether to sense the developer (operation 320). The overflow sensor 134 can sense the developer from the time when the developer fills up to the height H1. When the overflow sensor 134 does not sense the developer, the determining operation 320 can repeat to determine whether the overflow sensor 134 senses the developer.

If the overflow sensor 134 senses the developer, the recovery pump 136 can be operated after the time interval t2 lapses (operation 330). In this case, both of the supply pump 133 and the recovery pump 136 can operate, and the developer contained in the developer container 110 reaches at least the height H1.

Next, it is determined whether the overflow sensor 134 senses the developer (340). It is also determined whether the developer contained in the developer container 110 is gradually reduced and reached to the height H1 while the developer contained in the developer container 110 is recovered by the recovery pump 136.

If the overflow sensor 134 senses the developer, it indicates that the developer is not yet reduced down to the height H1. If it does not sense the developer, it indicates that the developer is reduced down to the height H1 while being recovered.

If the overflow sensor 134 does not sense the developer, the recovery pump 136 can be stopped after the time interval t4 lapses (operation 360). The recovery pump 136 stops to prevent the noise from being generated while the developer is recovered to the recovery line 135 together with the air if the developer is reduced down to the height H0.

It is determined whether the print operation is performed (operation 360) in the above state. If it is determined that the image forming apparatus is in a print state, the determining operation 320 can repeat the above operation, and if it is determined that the image forming apparatus is not in the print state, the procedure is ended.

As described above, the developer supply and recovery system of the wet electro-photographic image forming apparatus may have advantages in that the overflow sensor is installed to exactly sense the amount of the developer contained in the developer container, and it can be determined whether the supply pump and the recovery pump are normally operated, thereby securing reliability.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developer supply and recovery system used with a wet electro-photographic image forming apparatus, the system comprising:

an ink cartridge to store a developer;

a development bath to contain the developer supplied from the ink cartridge;

a developer container to receive the developer overflowing from the development bath;

a supply pump installed on a supply line to supply the developer from the ink cartridge to the development bath;

a recovery pump installed on a recovery line to recover the developer from the developer container to the ink cartridge;

an overflow sensor installed at the developer container to sense the developer overflowing from the development bath to generate a value; and a control unit to control the supply pump and the recovery pump to operate in response to the value generated from the overflow sensor.

2. The developer supply and recovery system of claim 1, wherein the overflow sensor is installed on an inside wall of the development container to sense an amount of the developer during supplying and recovering the developer.

3. The developer supply and recovery system of claim 1, wherein the overflow sensor generates the value representing a height of the developer with respect to the recovery line so that air is not introduced into the recovery line.

4. The developer supply and recovery system of claim 1, wherein the overflow sensor generates the value before the recovery pump operates to recover the developer from the developer container to the ink cartridge through the recovery line.

5. The developer supply and recovery system of claim 1, wherein the overflow sensor generates the value after the supply pump generates to supply the developer to the development bath.

6. The developer supply and recovery system of claim 1, wherein the control unit controls the recovery pump not to recover the developer when the value is less than a reference value.

7. The developer supply and recovery system of claim 1, wherein the control unit controls the recovery pump to stop recovering the developer when a time lapses after the value is less than a reference value.

8. The developer supply and recovery system of claim 1, wherein the control unit controls the recovery pump to start to recover the developer when the value becomes greater than a reference value.

9. The developer supply and recovery system of claim 1, wherein the value varies according to an amount of the developer, and the control unit controls the recovery pump to operate to recover the developer when a time lapses after the control unit controls the supply pump to supply the developer to the development bath.

10. The developer supply and recovery system of claim 1, wherein the control unit controls the recovery pump to stop recovering the developer when a time lapses after the value is less than a reference value.

11. The developer supply and recovery system of claim 1, wherein the control unit controls the recovery pump to stop recovering the developer when a time lapses after the supply pump stops supplying the developer.

12. The developer supply and recovery system of claim 1, wherein the control unit controls the recovery pump to recover the development when a first time lapses after the supply pump operates, and when a second time lapses after the value is greater than a reference value.

13. The developer supply and recovery system of claim 1, wherein the value varies according to an amount of the developer, and the control unit controls the supply pump and the recovery pump according to a variation of the value.

14. The developer supply and recovery system of claim 1, wherein the control unit controls the supply pump and the recovery pump according to at least one of a supply speed of the supply pump and a recovery speed of the supply pump.

15. The developer supply and recovery system of claim 14, wherein the control unit calculates the supply speed of the supply pump according to a period between a first time when the supply pump operates, and a second time when the value becomes greater than a reference.

16. The developer supply and recovery system of claim 14, wherein the control unit calculates the recovery speed of the recovery pump according to a period between a first time when the recovery pump operates, and a second time when the value does not become less than a reference value.

17. The developer supply and recovery system of claim 1, wherein the control unit generates a message indicating a malfunction state of the supply pump when a time lapses after the supply operates, and when the value of the overflow sensor is less than a reference value.

18. The developer supply and recovery system of claim 1, wherein the control unit generates a message indicating a malfunction state of the recovery pump when a time lapses after the recovery pump operates, and when the value of the overflow sensor is greater than a reference value.

19. A developer supply and recovery method of a wet electro-photographic image forming apparatus, the method comprising:

operating a supply pump to supply a developer from an ink cartridge to a development bath;

calculating a supply speed of the supply pump to determine whether the developer is normally supplied;

stopping the supply pump according to the supply speed;

operating a recovery pump to recover the developer overflowing from the development bath to the ink cartridge;

calculating a recovery speed of the recovery pump to determine whether the developer is normally recovered; and stopping the recovery pump according to at least one of the supply speed and the recovery speed.

20. The method of claim 19, wherein the determining of whether the developer is normally supplied, comprises:

determining whether a time interval lapses since the supply pump is operated;

determining whether an overflow sensor senses the developer contained in a developer container which receives the developer overflowing from the development bath;

calculating the supply speed of the developer according to the determining operations; and determining whether the supply pump is normally operated, according to the calculated supply speed.

21. The method of claim 20, further comprising:

displaying an operation error of the supply pump when the overflow sensor does not sense the developer.

22. The method of claim 19, wherein the determining of whether the developer is normally recovered, comprises:

determining whether a time interval lapses since the recovery pump is operated;

determining whether an overflow sensor senses the developer;

calculating the recovery speed of the developer according to the determining operations; and determining whether the recovery pump is normally operated, according to the calculated recovery speed.

23. The method of claim 22, further comprising:

displaying an operation error of the recovery pump when the overflow sensor senses the developer.

24. A developer recovery method of reducing a noise in an image forming apparatus, the method comprising:

operating a supply pump to supply a developer from an ink cartridge to a development bath;

determining whether an overflow sensor senses the developer;

operating a recovery pump to recover the developer overflowing from the development bath and contained in a developer container, from the developer container to the ink cartridge after a time interval lapses;

determining whether the overflow sensor senses the developer; and stopping the recovery pump after a time interval lapses, wherein air is prevented from being introduced from the developer container together with the developer, to reduce the noise.

* * * * *